US005259733A

United States Patent [19]

Gigliotti et al.

[11] Patent Number: 5,259,733

[45] Date of Patent: Nov. 9, 1993

[54] PUMP IN A WATER DISTRIBUTION NETWORK

[75] Inventors: Roberto Gigliotti, Lucca; Walter Manetti; Carlo Mensi, both of Florence, all of Italy

[73] Assignee: Watertech S.R.L., Florence, Italy

[21] Appl. No.: 964,254

[22] Filed: Oct. 21, 1992

[30] Foreign Application Priority Data

Oct. 21, 1991 [IT] Italy ..... MI 91 A 002777

[51] Int. Cl.[5] ..... F04D 15/02

[52] U.S. Cl. ..... 417/38; 417/43; 417/44

[58] Field of Search ..... 417/43, 44, 38

[56] References Cited

U.S. PATENT DOCUMENTS 3,918,843 11/1975 Douglas et al. ..... 417/43
4,247,260 1/1981 Schönwald et al. ..... 417/38

FOREIGN PATENT DOCUMENTS 2238799 2/1974 Fed. Rep. of Germany ..... 417/43
0191485 11/1982 Japan ..... 417/38

*Primary Examiner*—Richard A. Bertsch
*Assistant Examiner*—David W. Scheuermann
*Attorney, Agent, or Firm*—Sughrue, Mion, Zinn, Macpeak & Seas

[57] ABSTRACT

An apparatus for on/off controlling a pump in a water distribution network, which ensures a practically constant pressure through the distribution network, comprises, within a body, a chamber having an inlet conduit adapted for connection to the delivery side of the pump and an outlet conduit adapted for connection to the network, a pressure switch placed in said chamber to issue a start signal to the pump at a predetermined pressure setting, and a flow switch placed in the outlet conduit to issue a start signal to the pump upon the occurrence of a predetermined minimum flow or a stop signal to the pump in the event of the flow being interrupted.

7 Claims, 2 Drawing Sheets

PUMP IN A WATER DISTRIBUTION NETWORK

This invention relates to an apparatus for on/off controlling a pump in a water distribution network, as defined in the introductory part of the main claim.

While performing satisfactorily from several aspects and widely used, such apparatus give rise to noticeable surges in the pressure of the water they are supplying to the network, as explained herein below, with reference to a starting condition when all the outlets in the distribution network are shut off, the chamber is under maximum pressure, and the pump stopped.

In that condition, the pressure switch is inactive. On any outlet being opened, water flows from the chamber to the network, and the chamber internal pressure decreases to a predetermined set pressure at which the pressure switch becomes operative to start the pump. The water flow rate drives the check valve open-and water is admitted through the chamber to the network.

This approach has, therefore, a drawback in that the network pressure is to drop down to said setting of the pressure switch before the pump can be started.

But a further drawback becomes apparent when the demand for flow approximately matches the pump capacity. In operation, the pressure would then approach the setting of the pressure switch and cause the pump to be reiterately turned on and off.

An apparatus has been suggested, in U.S. Pat. No. 4,879,439, which has a flow switch associated with the check valve. Thus, on a demand for flow and with the check valve open, a signal is sent to the pump to hold it on, even if the pressure happens to exceed the pressure switch setting. This prior approach has been effective to avoid reiterate starts/stops of the pump, but has failed to prevent the pressure drop which occurs each time an outlet is opened.

The underlying problem of this invention is to provide an apparatus of the kind specified above which has such construction and performance features as to also overcome the latter drawback heretofore without remedy.

The solutive idea on which the invention stands is one of having the pump started upon a demand for flow from an outlet.

Based on this solutive idea and to solve the aforesaid technical problem, this invention provides an apparatus as indicated, according to the characterizing part of the main claim.

Figure 1:
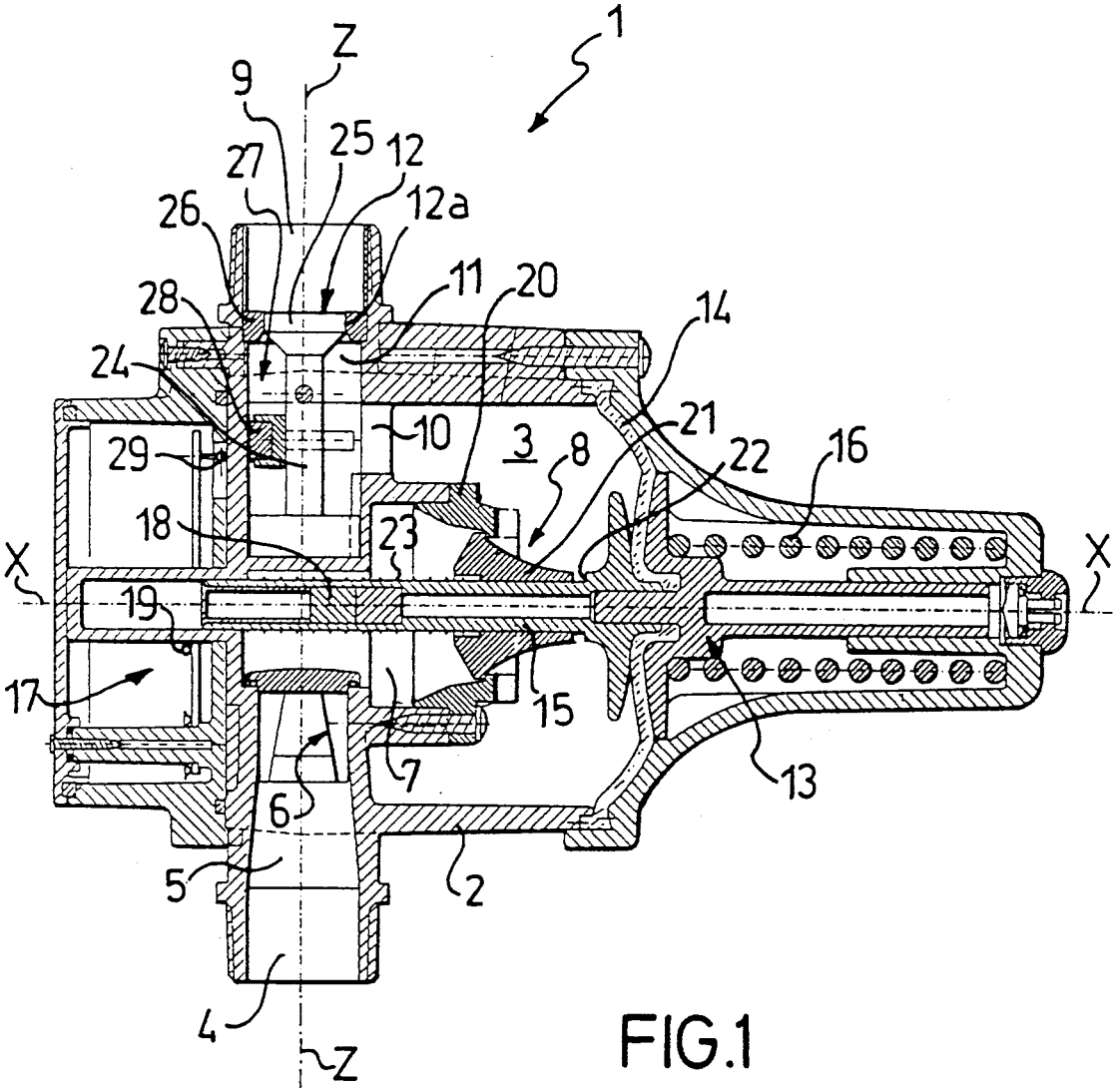
Figure 2:
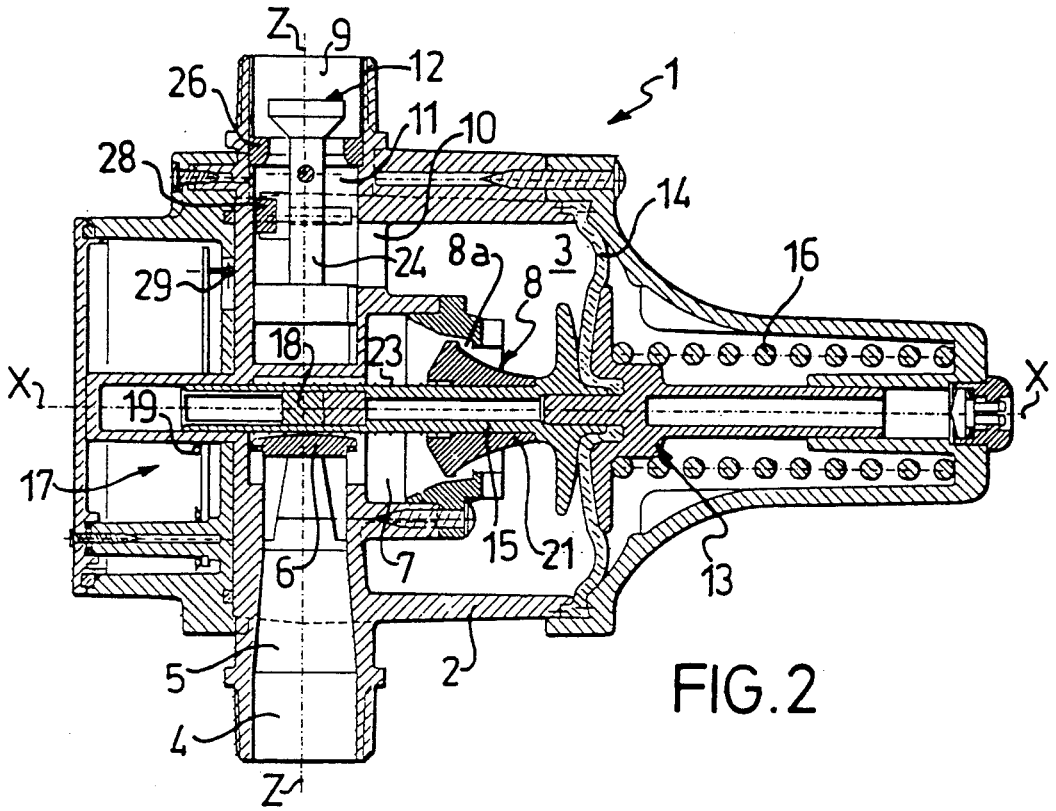
Figure 3:
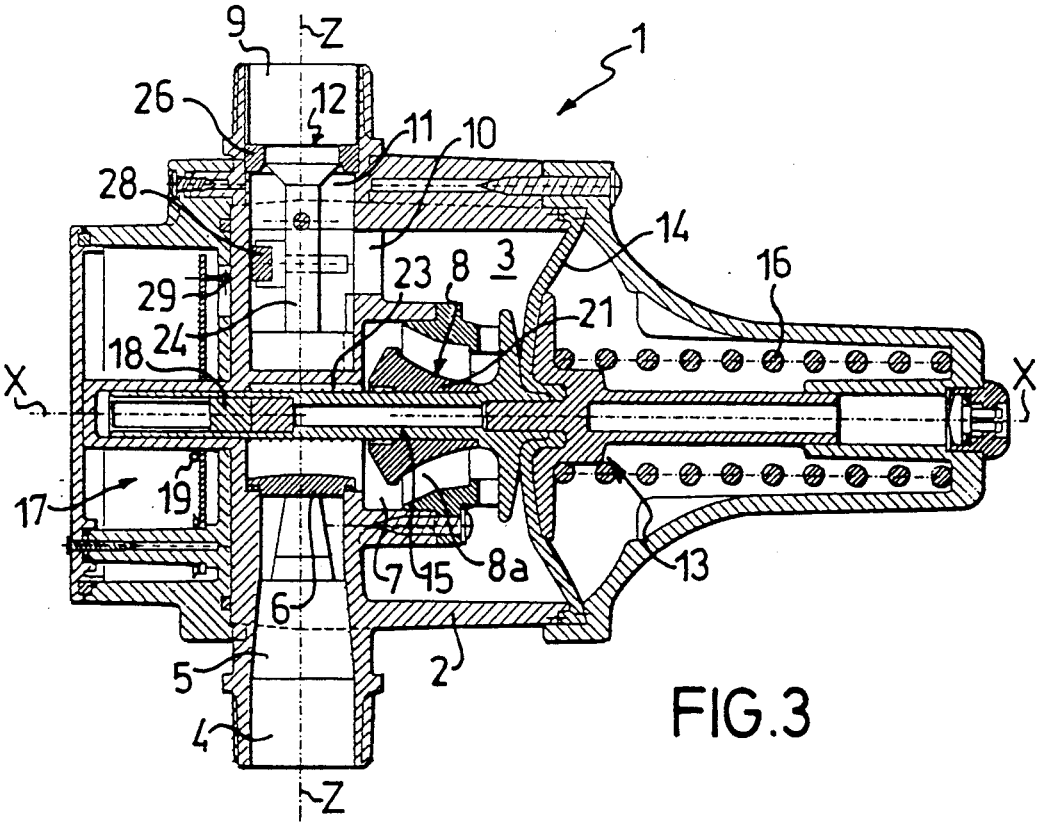

Further features and the advantages of an apparatus according to the invention will be apparent from the following detailed description of a preferred embodiment thereof, given by way of example and not of limitation with reference to the accompanying drawing figures which show:

FIG. 1, a sectional view through an apparatus according to the invention, and FIGS. 2 and 3, sectional views through the apparatus of FIG. 1 but taken at different stages of its operation.

With reference to the drawing figures, generally shown at 1 is an apparatus according to the invention.

The apparatus 1 comprises a substantially cylindrical body 2 about a horizontal axis X—X in which a chamber 3 is formed.

The chamber 3 has an inlet conduit 4 adapted to be connected to the delivery side of a pump. The conduit 4 has a first, upright section 5 having an axis Z—Z and incorporating a check valve 6, and a horizontal section 7 coaxial with X—X incorporating a throttle 8 to be described.

The chamber 3 has an outlet conduit 9 adapted for connection to a water distribution network for one or more outlets. The conduit 9 includes a horizontal section 10 and an upright section 11 having an axis Z—Z and incorporating a flow switch 12.

Located within the chamber 3 is a pressure switch 13 of the membrane type.

Specifically, the pressure switch 13 comprises a membrane 14 which delimits the chamber 3 and is acted upon by the water pressure.

The membrane 14 is ring-shaped about an axis X—X, is attached peripherally to the body 3, and is provided centrally with a stem 15 extending along axis X—X through the section 7 of the inlet conduit. The membrane 14 is acted upon centrally by a spring 16 and is deformable by the action of the pressure prevailing within the chamber 3 against the bias force of the spring 16. Thus, the stem can be moved between a position where it is received fully inside the chamber and a partly extended position.

The pressure switch 13 also comprises a sensor 17 for sensing the stem position. The sensor 17 is formed by a magnet 18 associated with the stem 15 and a bulb 19 associated with the body 3 and responsive to the magnet. The magnet and bulb are mutually engaged at a predetermined pressure setting, and held apart upon the pressure rising above that setting.

In a condition of mutual engagement of the magnet and the bulb, the sensor issues a signal to start the pump.

The throttle 8 comprises a shutter seat 20, rigid with the body 3 and having a substantially conical converging profile, and a shutter 21 associated with the stem 15, also having a substantially conical converging profile.

Thus, between the profile of the shutter seat 20 and the profile of the shutter 21 there is formed a passageway 8*a* whose cross-section changes with the stem position. In particular, this cross-section will be greater with the stem more deeply inserted into the chamber, that is when the pressure within the chamber is least, and vice versa.

The shutter 21 is fitted coaxially over the stem 15 and constantly biased against a shoulder 22 on the stem by a spring 23.

Upon the pressure within the chamber exceeding a predetermined value, whereby the stem is moved past a predetermined rearward position, the shutter will engage the shutter seat, shut off the flow passageway, and slide relative to the stem against the bias of the spring, thus holding the flow passageway shut off.

The flow switch 12, which comprises a cursor 24, is guided slidingly along the upright section 11 of the outlet conduit 9 and movable upwards by the flow acting against its own weight.

In particular, the cursor 24 has a portion 25 which forms, in co-operation with a collar 26 projecting from the upright section 11 of the conduit 9, an interspace 12*a* having a given hydraulic resistance, sized such that on a minimum predetermined flow moving past, a sufficient pressure surge is created to overcome the weight of the cursor and push it upwards.

The flow switch 12 is completed by a sensor 27 for the cursor position. The sensor 27 is formed by a magnet 28 associated with the cursor 24 and a bulb 29 associated with the body 2 and responsive to the magnet.

The magnet 28 and bulb 29 are mutually engaged while the flow is below said predetermined minimum value and the cursor occupies its lower position under its own weight. In the disengaged condition of the magnet and the bulb, the sensor sends a start signal to the pump.

The operation of this apparatus will now be described with reference to an initial condition (see FIG. 1) with the chamber under maximum pressure and a null flow.

Upon an outlet being opened, downstream from the cursor there occurs a pressure drop which causes the cursor to move upwards and the pump to start at once and fill the demand for flow.

In the event that the flow be not imposed by an outlet being opened but by some loss in the distribution network whereby it drops below said predetermined minimum flow value, the cursor is held in its lowered position and the pump not started. In this case, the pump would only be started when, after a time period, the pressure switch signals that the pressure has dropped to the aforesaid setting value.

Should, with the pump on, the flow be interrupted or drop below its predetermined minimum value, with the pressure concurrently down to its setting value, the cursor would move down and send a stop signal to the pump. In this condition, typically bound to arise when the pump suction side dries out, the stopped pump will be safeguarded against anomalous operation endangering its integrity.

A major advantage of the apparatus according to the invention is that it can provide a uniquely constant pressure to the outlets from the very moment that water begins to be supplied to an outlet.

A further advantage of the apparatus according to the invention is that its constant flow feature is brought about by the provision of a throttle in the inlet conduit.

It should be noted, finally, that the apparatus of this invention has proved to be a simple and reliable construction, thereby it can be expected to have a long troublefree life.

Understandably, the apparatus described hereinabove may be altered and modified in several ways by a skilled person in the art for the purpose of filling specific contingent demands, without departing from the protection scope of this invention as defined in the appended claims.

We claim:

1. An apparatus adapted to be connected to a pump for on/off controlling a pump in a water distribution network, said apparatus comprising a body, a chamber having an inlet conduit adapted for connection to the delivery side of a pump and an out outlet conduit adapted for connection to a network, a check valve in the inlet conduit, and a pressure switch in said chamber for issuing a start signal to a pump at a predetermined pressure setting, wherein the apparatus comprises a flow switch in the outlet conduit for issuing a start signal to a pump upon the occurrence of a predetermined minimum flow.

2. An apparatus according to claim 1, wherein said flow switch comprises a cursor guided slidingly in the outlet conduit and movable upwards by the flow against its own weight, and a sensor for sensing the cursor position comprising a magnet associated with the cursor and a bulb associated with the body.

3. An apparatus according to claim 2, further comprising a throttle located in the inlet conduit and driven by the pressure switch.

4. An apparatus adapted to be connected to a pump for on/off controlling a pump in a water distribution network, said apparatus comprising a body, a chamber having an inlet conduit adapted for connection to the delivery side of a pump and an outlet conduit adapted for connection to a network, a check valve in the inlet conduit, a pressure switch in said chamber comprising a membrane facing said chamber and being deformable under the action of the internal pressure of the chamber against the bias force of a spring opposing the pressure, a stem associated with the membrane, and a sensor for sensing the stem position comprising a magnet associated with the stem and a bulb responsive to the magnet and associated with the body, said sensor being adapted to issue a start signal to a pump when the magnet and bulb are mutually engaged, wherein the apparatus comprises a flow switch located in the outlet conduit for issuing a start signal to a pump upon the occurrence of a predetermined minimum flow.

5. An apparatus according to claim 4, wherein said flow switch comprises a cursor movable upwards by the flow acting against its own weight, and a sensor for sensing the cursor position comprising a magnet associated with the cursor and a bulb responsive to the magnet and associated with the body.

6. An apparatus according to claim 5, further comprising a throttle located in the inlet conduit and driven by the stem.

7. An apparatus according to claim 6, wherein said throttle comprises a shutter seat being rigid with the body and having a substantially conical converging profile, and a shutter being associated with the stem and having a substantially conical converging profile, between said profiles there being formed a passageway whose cross-section varies with the stem position.

* * * * *